United States Patent [19]

Halter

[11] 4,089,757

[45] May 16, 1978

[54] ELECTROCHEMICAL OXIDATION OF ALKOXY-SUBSTITUTED AROMATIC COMPOUNDS

[75] Inventor: Mark A. Halter, Arlington Heights, Ill.

[73] Assignee: UOP Inc., Des Plaines, Ill.

[21] Appl. No.: 836,931

[22] Filed: Sep. 27, 1977

Related U.S. Application Data

[63] Continuation-in-part of Ser. No. 752,652, Dec. 20, 1976.

[51] Int. Cl.[2] ..... C25B 3/02

[52] U.S. Cl. ..... 204/78

[58] Field of Search ..... 204/78

[56] References Cited

U.S. PATENT DOCUMENTS 4,046,652 9/1977 Pistorius et al. ..... 204/78

*Primary Examiner*—R. L. Andrews

*Attorney, Agent, or Firm*—James R. Hoatson, Jr.; Raymond H. Nelson; William H. Page, II

[57] ABSTRACT

The electrochemical oxidation of alkoxy-substituted aromatic compounds may be effected by treating the aromatic compound with propionic acid in the presence of a phase transfer agent, said reaction being effected in an electrochemical cell. In the present invention the position isomer which comprises the para compound is prepared in a favorable ratio over the ortho isomer by treating a substituted aromatic compound such as anisole with propionic acid in an electrochemical cell whereby the desired oxidized product is recovered on the anode.

13 Claims, No Drawings

ELECTROCHEMICAL OXIDATION OF ALKOXY-SUBSTITUTED AROMATIC COMPOUNDS

CROSS-REFERENCE TO RELATED APPLICATIONS

This application is a continuation-in-part of my copending application Ser. No. 752,652 filed Dec. 20, 1976, all teachings of which are specifically incorporated herein by reference.

BACKGROUND OF THE INVENTION

It has been shown in the prior art that desired position isomers such as the ortho isomer may be obtained by adding $\pi$-donating compounds such as polynuclear aromatic compounds such as naphthalene and anthracene to a reaction mixture. Likewise, the prior art has also disclosed that when anisole is subjected to an acetoxylation process, the ortho to para ratio is about 2:1 at low conversions of from 5% to 10% and increases to about 4:1 at a 25% conversion of the anisole. The usual prior art systems which were employed in the acetoxylation of aromatic compounds utilized non-emulsion conditions. This type of reaction required a relatively high operating voltage in the range of about 20 volts in order to obtain a reasonable current density. Therefore, the desired products were obtained at a high cost of power per pound of product.

In many instances, it has been found that the desired position isomer comprises the para isomer and therefore it has been discovered that by effecting the electrochemical oxidation of alkoxy-substituted aromatic compounds in the presence of propionic acid and an alkali metal or alkaline earth metal salt thereof and also in the presence of a phase transfer agent, it is possible to obtain the para isomer in an amount greater than that of the ortho isomer, the system being effected in such a manner so that the selectivity to the desired products is increased while the oxidation of the carboxylate is decreased.

This invention relates to a process for the electrochemical oxidation of alkoxy-substituted aromatic compounds. More specifically, the invention is concerned with a process for obtaining improved yields of the desired position isomer during the electrochemical oxidation of alkoxy-substituted aromatic compounds with a correspondingly lower loss of the attacking species.

Certain chemical compounds, and especially those which contain two substituents in a position para to each other, comprise desired reaction products which are useful in the chemical field. For example, hydroxyanisole may be synthesized electrochemically from anisole. The reaction is carried out in an electrochemical cell so that the desired product is obtained at the anode, said reaction involving the anodic oxidation of anisole in the presence of a nucleophile such as acetate ions which lead to acetoxylation in the ortho and para positions. The para isomer of the reaction constitutes a valuable intermediate inasmuch as the acetoxylated product in which the acetoxy substituent is in a para position is an intermediate for the production of p-hydroxyanisole, this compound being the precursor of t-butylhydroxyanisole which is an antioxidant useful in preventing the oxidation of edible fats and oils. In addition to being admixed with these fats and oils it is also used in food packaging, the wrappings for the foods containing this compound. In addition, other position isomers such as the ortho isomer also constitute marketable compounds of importance in the chemical field.

It is therefore an object of the present invention to provide a process for the electrochemical oxidation of alkoxy-substituted aromatic compounds.

A further object of this invention is to provide a method for obtaining improved yields of desired position isomers which result from the electrochemical oxidation of alkoxy-substituted aromatic compounds.

In one aspect an embodiment of this invention resides in a process for the electrochemical oxidation of an alkoxy-substituted aromatic compound, the improvement which comprises effecting said electrochemical oxidation in an electrochemical cell in the presence of propionic acid, an alkali metal or alkaline earth metal salt thereof and a phase transfer agent comprising a symmetrical or asymmetrical tetraalkylnitrogen or phosphonium-based salt containing from 1 to about 20 carbon atoms in the chain, and recovering the resultant acetoxylated alkoxy-substituted aromatic compound.

A specific embodiment of this invention resides in a process for the electrochemical oxidation of an alkoxy-substituted aromatic compound which comprises treating anisole with propionic acid and sodium propionate in the presence of tetrapropylammonium hydroxide in an electrochemical cell utilizing electrical energy conditions which include a voltage in the range of from about 2 to about 20 volts and a current density in the range of from about 20 to about 200 milliamps per square centimeter ($mA/cm^2$) at ambient temperature and atmospheric pressure and recovering the resultant p-propoxyanisole.

Other objects and embodiments will be found in the following further detailed description of the present invention.

As hereinbefore set forth the present invention is concerned with a process for the electrochemical oxidation of alkoxy-substituted aromatic compounds whereby a desired position isomer, and particularly the para isomer, of a di-substituted compound is obtained. The electrochemical oxidation is effected by treating an alkoxy-substituted aromatic compound of the type hereinafter set forth in greater detail with propionic acid and an alkali metal or alkaline earth metal salt thereof in the presence of a phase transfer agent in an electrochemical cell. By utilizing such a combination of salts such as the acid salt, water, organic solvent and phase transfer agent, it is possible to provide an emulsion medium in which to effect the electrochemical oxidation of the aromatic compound.

By utilizing propionic acid as the attacking nucleophile during the anodic oxidation of the alkoxy-substituted aromatic compound under emulsion conditions, it is possible to effect the reaction under more favorable conditions than can be found when utilizing other acids as the attacking nucleophile. For example, by utilizing propionic acid, it is possible to greatly increase the percentage of current which is utilized in the desired oxidation of the alkoxy-substituted aromatic compound, to increase the selectivity to the desired products as well as suppressing the oxidation of the attacking nucleophile. The latter is important inasmuch as in the event that less propionic acid is attacked and oxidized the more can be recovered and recycled for further use in the reaction. The decrease in the Kolbe oxidation constitutes an essential advance towards a commercial utilization of the process inasmuch as it will enable the process to be effected in a more economical manner.

While the use of other acids as the attacking nucleophile may result in the oxidation of a greater percentage of the desired para isomer over the ortho isomer, this advantage may be nullified or negated by the consumption of the attacking nucleophile, thus necessitating the use of a greater amount of the acid during the reaction, with an attendant rise in the cost of the desired product.

Examples of alkoxy-substituted aromatic compounds (also known as alkylaromatic ethers) which will undergo the electrochemical oxidation will include methyl phenyl ether (anisole), ethyl phenyl ether (phenetole), propyl phenyl ether (propoxybenzene), isopropyl phenyl ether (isopropoxybenzene), n-butyl phenyl ether, sec-butyl phenyl ether, t-butyl phenyl ether, n-amyl phenyl ether, isoamyl phenyl ether, the isomeric hexyl, heptyl, octyl, nonyl, decyl, etc., phenyl ethers, etc.

The aforementioned alkoxy-substituted aromatic compounds are treated with propionic acid and, in addition, an alkali metal or alkaline earth metal salt thereof such as sodium propionate, potassium propionate, lithium propionate, cesium propionate, magnesium propionate, calcium propionate, strontium propionate, etc. The alkali metal or alkaline earth metal salt may be added separately or, if so desired, the alkaline salts may be formed in situ by adding an alkaline compound such as sodium hydroxide, potassium hydroxide, lithium hydroxide, calcium hydroxide, magnesium hydroxide, etc., to the reaction medium, thereby converting a portion of the acid which is present to the salt thereof.

In addition to the presence of the propionic acid and the corresponding alkali metal or alkaline earth metal salt thereof, the reaction is also effected in the presence of a phase transfer agent. In the preferred embodiment of the invention, these phase transfer agents will comprise symmetrical or asymmetrical tetraalkylnitrogen-based or phosphorus-based salts in which the alkyl radicals contain from 1 to 20 carbon atoms in the chain. Some specific examples of these phase transfer agents will include tetramethylammonium hydroxide, tetraethylammonium hydroxide, tetrapropylammonium hydroxide, tetrabutylammonium hydroxide, tetrapentylammonium hydroxide, tetrahexylammonium hydroxide, tetranonylammonium hydroxide, tetradecylammonium hydroxide, tetradodecylammonium hydroxide, butyltrimethylammonium hydroxide, hexyltrimethylammonium hydroxide, heptyltrimethylammonium hydroxide, decyltrimethylammonium hydroxide, dodecyltrimethylammonium hydroxide, hexadecyltrimethylammonium hydroxide, eicosyltrimethylammonium hydroxide, diethyldimethylammonium hydroxide, dipropyldimethylammonium hydroxide, dibutyldimethylammonium hydroxide, dihexyldimethylammonium hydroxide, didecyldimethylammonium hydroxide, tributylammonium hydroxide, triheptylmethylammonium hydroxide, trinonylmethylammonium hydroxide, triundecylmethylammonium hydroxide, tripentadecylmethylammonium hydroxide, dibutyldiethylammonium hydroxide, dioctyldiethylammonium hydroxide, the corresponding sulfate, nitrate, chloride and bromide salts, etc.; tetramethylphosphonium hydroxide, tetrapropylphosphonium hydroxide, tetrapentylphosphonium hydroxide, tetrononylphosphonium hydroxide, tetradodecylphosphonium hydroxide, hexyltrimethylphosphonium hydroxide, decyltrimethylphosphonium hydroxide, hexadecyltrimethylphosphonium hydroxide, diethyldimethylphosphonium hydroxide, dibutyldimethylphosphonium hydroxide, didecyldimethylphosphonium hydroxide, triheptylmethylphosphonium hydroxide, triundecylmethylphosphonium hydroxide, dibutyldiethylphosphonium hydroxide, etc., the corresponding sulfate, nitrate, chloride and bromide salts, etc. It is to be understood that the aforementioned phase transfer agents are only representative of the types of agents which may be employed and that the present invention is not necessarily limited thereto.

In addition to utilizing these various phase transfer agents it is also possible, by varying the chain length of the phase transfer agent which is employed in the reaction, to vary the ratio of ortho to para substituents, the product isomer selectivity being influenced by the number of carbon atoms in the alkyl groups. For example, by utilizing alkyl compounds which are relatively short in nature such as tetraethylammonium hydroxide, it is possible to obtain a greater ratio of para to ortho isomers than can be obtained when utilizing tetraalkyl compounds in which the alkyl radical is relatively long in nature, such as tricaprylylmethylammonium hydroxide.

The electrochemical cell in which the electrochemical oxidation of the alkoxy-substituted aromatic compound is effected may be of any variety which is well known in the art. The electrodes which are employed may be formed of any conductive material, the preferred electrodes in the process of this invention comprising a platinum anode and a stainless steel cathode, although it is also contemplated that other materials such as graphite may also be employed. The electrochemical oxidation is effected utilizing an electrical energy which includes a voltage within the range of from about 2 to about 20 volts and a current density in the range of from about 20 to about 500 mA/cm$^2$. By utilizing a water emulsion which will include the aforementioned phase transfer agent, propionic acid, and alkaline salt thereof, as well as an organic solvent such as dichloromethane, diethyl ether, acetonitrile, etc., it will be possible to utilize a lower voltage and current density thereby reducing the power cost which will be required to effect the electrochemical oxidation.

The aforesaid components of the reaction mixture will generally be present in amounts ranging from about 0.01 to about 0.2 moles of alkoxy-substituted aromatic compound, about 0.01 to about 0.8 moles of propionate, about 0.02 to about 0.4 moles of propionic acid and about 0.015 moles of phase transfer agent per 100 cc of water.

The process of this invention may be effected in any suitable manner and may include both a batch type and continuous type operation. When a batch type operation is employed, an emulsion which will include the alkoxy-substituted aromatic compound such as anisole, the propionic acid, the alkali metal or alkaline earth metal salt thereof, water, the organic solvent and the phase transfer agent are charged to a flask which is provided with an overhead stirrer, reflux condenser and nitrogen purge tube. In addition, the flask is also provided with a bottom exit tube. The solution is then stirred and transferred from the flask to the electrochemical cell in a multi-pass recycle operation where the alkoxy-substituted aromatic compound is subjected to an electrochemical reaction for a predetermined period of time which may range from about 0.5 up to about 10 hours or more in duration, the electrical energy charged to the cell being within the range hereinbefore set forth. Upon completion of the desired residence time, the mixture is withdrawn from the cell and subjected to conventional means of separation which will include decantation, washing, drying, fractional distillation, etc., whereby the desired product is separated from unreacted starting materials, phase transfer agents, water, organic solvent, etc., and recovered.

It is also contemplated within the scope of this invention that the electrochemical oxidation of the alkoxy-substituted aromatic compound may also be effected in a continuous manner of operation. When such as type of operation is used, the aforementioned components of the reaction mixture, namely, the alkoxy-substituted aromatic compound, the propionic acid, its alkali metal or alkaline earth metal salt thereof, water, phase transfer agent and the organic solvent are also continuously charged to an electrochemical cell which is maintained at the proper operating conditions of temperature and pressure, said preferred conditions including ambient temperature and atmospheric pressure. After cycling through the cell and being subjected to an electrical charge for a predetermined period of time, the effluent is continuously withdrawn and subjected to conventional means of separation whereby the desired product is recovered.

The following examples are given to illustrate the process of this invention in which a preferred position isomer, namely, the para isomer, of an alkoxy-substituted aromatic compound which has been subjected to electrochemical oxidation is prepared and recovered. However, it is to be understood that these examples are given merely for purposes of illustration and that the present invention is not necessarily limited thereto.

EXAMPLE I

In this example a mixture consisting of 5.4 grams (0.5 mole) of anisole, 8.0 grams (0.20 mole) of sodium hydroxide, 22.2 grams (0.30 mole) of propionic acid along with 70 grams of water, 100 ml of methylene chloride and 30.2 grams of a 10% solution of tetrapropylammonium hydroxide was admixed in a flask provided with an overhead stirrer, reflux condenser and nitrogen purge tube. In addition, the flask also contained a bottom exit tube and stopcock. The solution, after being stirred, was transferred from the flask through a flow cell which was provided with Teflon walls, a platinum anode and a stainless steel cathode. The electrical energy which was used consisted of an E applied voltage of 4.3 volts along with about 0.5 amps while maintaining the current density at a rate of about 25 mA/cm$^2$, the interelectrode spacing being 2.5 mm. The solution was passed through the cell and condenser and back to the cell by use of a pump. The reaction was effected for a period of about 2 hours. It was found that there was a 33.2% conversion with a 51.3% selectivity to the propoxy anisoles, the ratio of ortho to para isomers being 46:54. In addition, there was also an 85.4% current efficiency toward the anisole conversion and a 43.8% current efficiency toward propionate production.

EXAMPLE II

In a manner similar to that set forth in Example I, a mixture comprising 10.8 grams (0.10 mole) of anisole, 16.0 grams (0.40 mole) of sodium hydroxide, 44.4 grams (0.60 mole) of propionic acid along with 70 grams of water, 100 ml of methylene chloride and 30.2 grams of a 10% solution of tetrapropylammonium hydroxide was admixed and treated in a flow cell. The electrochemical oxidation reaction was effected for a period of about 4 hours at ambient temperature and pressure using an E applied voltage of approximately 4 volts and 0.5 amps while maintaining the current density at about 25 mA/cm$^2$. It was found that there had been a 34.3% conversion with a 69.5% selectivity to the propioanisoles. In addition, there was an 88.6% current efficiency to the anisole conversions and a 61.6% current efficiency to the anisyl propionates. In addition, it was found that the ratio of ortho to para isomers was 45:55.

EXAMPLE III

To illustrate the difference in current efficiencies and conversions when utilizing propionic acid as compared to a more bulky acid, another example was performed in which 5.4 grams (0.5 mole) of anisole, 8.0 grams (0.20 mole) of sodium hydroxide, and 30.6 grams (0.30 mole) of pivalic acid along with 70 grams of water, 133.5 grams of methylene chloride and 30.2 grams (0.015 mole) of a 10% tetrapropylammonium hydroxide solution were admixed and treated in a manner similar to that set forth in the above examples. The reaction was effected for a period of about 5 hours at ambient temperature and pressure using an E applied voltage of about 5 volts and 0.43 amps while maintaining the current density at about 25 mA/cm$^2$. Upon completion of the reaction, it was found that there had been a 40.72% conversion with a 41.7% selectivity to the substituted anisoles, the ortho to para ratio of isomers being 36:64. In addition, the current efficiency was only 52% based on the anisole conversion in contrast to the 85.4% current efficiency found in Example I and an 88.6% current efficiency found in Example II. In addition, it was also found that a large percentage of the pivalic acid which is relatively expensive was attacked in contrast to the propionic acid in which 96% of said propionic acid was recovered.

It is readily apparent, therefore, from a comparison of the above examples that by utilizing propionic acid as the attacking nucleophile in an electrochemical oxidation of alkoxy-substituted aromatic compounds such as anisole, it is possible to obtain a greater selectivity and a greater current efficiency than is possible when using a more bulky acid.

EXAMPLE IV

In this example a mixture comprising 216.0 grams (2.0 moles) of anisole, 320 grams (8.0 moles) of sodium hydroxide, 902 grams (12.2 moles) of propionic acid, 1000 grams of water, 1333 grams of methylene chloride and 80 grams of a 43.4% solution of dodecyltrimethylammonium chloride was charged to a reservoir and circulated through a pumping loop for 5 minutes while simultaneously being exposed to a steady stream of nitrogen gas. The electrochemical cell which was employed for this reaction was provided with a graphite anode and a platinum cathode. The electrical energy which was employed for the electrochemical oxidation reaction consisted of an E applied voltage of from 4.0 to 4.2 volts along with about 10 amps while maintaining the current density at a rate of about 100 mA/cm$^2$. The reaction was allowed to proceed for a period of about 6 hours. At the start of the reaction the nitrogen stream was discontinued and a steady flow of gas was evidenced by use of a bubble tube. At the end of the six-hour period the solution was pumped into a 4 liter flask following which the system was washed with 1 liter of methylene chloride and 1 ml of water. The washings were collected and retained while the original reaction mixture was placed in a separatory funnel and the organic layer separated from the water layer. The flush mixture was then separated and the organic layer retained. The aqueous layer was washed two times with 4 ml of methylene chloride following which the organic layer was separated and retained. The organic layers were then combined and the methylene chloride solvent was removed by distillation. The reaction mixture which remained in the distillation apparatus after a temperature of 75° C. had been attained was subjected to internal standard gas liquid chromatographic analysis. It was found that there had been an average conversion of 31.9% with an 88.4% selectivity. In addition there had been a 54.7% current efficiency toward the conversion of anisole to propoxyanisole with an ortho to para isomer ratio of 44:56.

EXAMPLE V

To illustrate the use of a variation of the electrical energy 216 grams of anisole, 323 grams of sodium hydroxide, 860 grams of propionic acid, along with 1009 grams of water, 1000 ml of methylene chloride and 97 grams of a 43.4% solution of dodecyltrimethylammonium chloride were subjected to an electrochemical reaction similar in nature to that hereinbefore set forth in Example IV. The reaction was effected for a period of 1.5 hours using an electric energy which consisted of an E applied voltage of from 9 to 10 volts along with 40 amps while maintaining the current density at a rate of about 100 mA/cm$^2$. After treatment of the reaction mixture in a similar manner analysis showed that there had been a 26.4% conversion of anisole to propoxyanisole with a 95.2% selectivity. In addition, there was found to be a 47.2% current efficiency toward the anisole conversion with an ortho to para isomer ratio of 50:50.

EXAMPLE VI

The treatment of anisole with propionic acid, sodium or potassium hydroxide, water and other phase transfer agents such as tetra-t-butylammonium sulfate, tetraethylphosphonium chloride, diethyldi-t-butylphosphonium sulfate, etc., in an electrochemical cell utilizing platinum anodes and stainless steel or graphite cathodes and utilizing electrical energy within the range hereinbefore set forth may produce similar results in the conversion of anisole to propoxyanisole.

I claim as my invention:

1. In a process for the electrochemical oxidation of an alkoxy-substituted aromatic compound, the improvement which comprises effecting said electrochemical oxidation in an electrochemical cell in the presence of propionic acid, an alkali metal or alkaline earth metal salt thereof and a phase transfer agent comprising a symmetrical or asymmetrical tetraalkylnitrogen or phosphonium-based salt containing from 1 to about 20 carbon atoms in the chain, and recovering the resultant acetoxylated alkoxy-substituted aromatic compound.

2. The process as set forth in claim 1 in which said transfer agent is a tetraalkylammonium salt.

3. The process as set forth in claim 2 in which said salt is tetrapropylammonium hydroxide.

4. The process as set forth in claim 2 in which said salt is dodecyltrimethylammonium chloride.

5. The process as set forth in claim 2 in which said salt is tetra-t-butylammonium sulfate.

6. The process as set forth in claim 1 in which said transfer agent is a tetraalkylphosphonium salt.

7. The process as set forth in claim 6 in which said salt is tetraethylphosphonium chloride.

8. The process as set forth in claim 6 in which said salt is diethyldi-t-butylphosphonium sulfate.

9. The process as set forth in claim 1 in which said electrochemical oxidation is effected utilizing electrical energy which includes a voltage in the range of from about 2 to about 20 volts and a current density in the range of from about 20 to about 200 milliamps per square centimeter.

10. The process as set forth in claim 1 being effected at ambient temperature and atmospheric pressure.

11. The process as set forth in claim 1 in which said alkali metal salt is sodium propionate.

12. The process as set forth in claim 1 in which said alkali metal salt is potassium propionate.

13. The process as set forth in claim 1 in which said alkoxy-substituted aromatic compound is anisole and said acetoxylated alkoxy-substituted compound is propoxyanisole.

* * * * *